US010922940B1

(12) United States Patent
Chin

(10) Patent No.: US 10,922,940 B1
(45) Date of Patent: Feb. 16, 2021

(54) BATTERY-POWERED RADIO FREQUENCY MOTION DETECTOR

(71) Applicant: Amazon Technologies, Inc., Seattle, WA (US)

(72) Inventor: Douglas Mark Chin, Windham, NH (US)

(73) Assignee: AMAZON TECHNOLOGIES, INC., Seattle, WA (US)

( * ) Notice: Subject to any disclaimer, the term of this patent is extended or adjusted under 35 U.S.C. 154(b) by 0 days.

(21) Appl. No.: 16/210,668

(22) Filed: Dec. 5, 2018

(51) Int. Cl.
*G08B 13/24* (2006.01)
*G08B 13/196* (2006.01)

(52) U.S. Cl.
CPC ... *G08B 13/2494* (2013.01); *G08B 13/19695* (2013.01)

(58) Field of Classification Search
CPC ..... G08B 13/2491; G08B 13/2494; G08B 13/26; G08B 12/19695; G08B 25/00; B60R 25/104; B60R 25/2009; H04M 11/04
USPC ..... 340/541, 565, 567
See application file for complete search history.

(56) References Cited

U.S. PATENT DOCUMENTS 4,827,264 A * 5/1989 Bjelk ..... G01S 13/56 342/61
5,287,111 A * 2/1994 Shpater ..... G01S 7/282 342/173
7,242,295 B1 * 7/2007 Milinusic ..... G08B 13/19634 340/506
2007/0124674 A1 * 5/2007 Liao ..... G06F 3/044 715/702
2012/0021698 A1 * 1/2012 Borlez ..... G01S 13/756 455/73
2017/0018158 A1 * 1/2017 Sayavong ..... G06F 16/951
2017/0223807 A1 * 8/2017 Recker ..... H05B 47/16
2017/0353189 A1 * 12/2017 Chen ..... H03L 7/087
2018/0249297 A1 * 8/2018 Taylor ..... G01S 1/06
2019/0206235 A1 * 7/2019 DiPoala ..... G08B 13/2491
2019/0212432 A1 * 7/2019 DiPoala ..... G01P 13/00
2019/0215930 A1 * 7/2019 Chen ..... G01S 13/56

* cited by examiner

*Primary Examiner* — Eric Blount
(74) *Attorney, Agent, or Firm* — K&L Gates LLP

(57) ABSTRACT

Techniques are generally described for motion detection by supplying voltage pulses to a radio frequency (RF) circuit. In some examples, an RF motion detection circuit may output a first RF signal based at least in part on a first voltage pulse. In some further examples, the RF motion detection circuit may receive a second RF signal, the second RF signal being the first RF signal reflected from an environment external to the RF motion detection circuit. In some further examples, the first RF signal and the second RF signal may be mixed to generate a difference component signal. A first output voltage representing the difference component signal may be generated. In some examples, the first output voltage may be used to detect motion in the environment.

20 Claims, 6 Drawing Sheets

BATTERY-POWERED RADIO FREQUENCY MOTION DETECTOR

BACKGROUND

Security systems may use one or more cameras to capture video data of areas of interest. For example, video security cameras may be positioned so as to surveil an entryway into a secure area such as a bank vault or an entrance to a private residence. Security camera systems sometimes use motion detection to initiate video capture and/or video streaming to one or more other devices. For example, upon detection of motion in video data, a camera may be configured to capture and send a live feed of video from the camera to a cloud-based server system, a central computing device, and/or to a mobile application executing on a mobile phone. In other examples, upon detection of motion in video data, a camera may begin storing captured video data in a data storage repository. In various examples, cameras may include infrared light sources in order to capture image data and/or video data in low light conditions.

DETAILED DESCRIPTION

Figure 1:
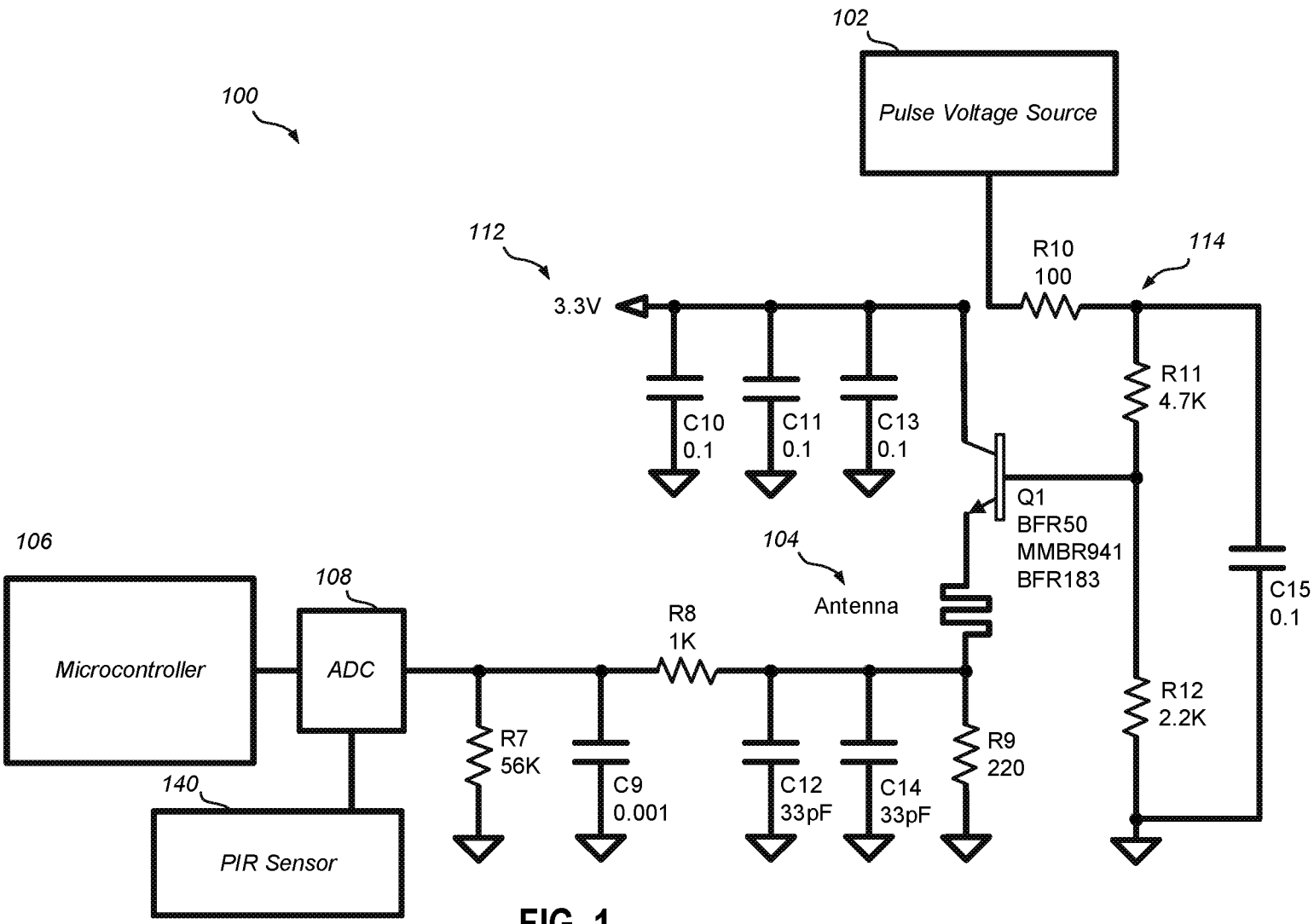
FIG. 1 depicts an example circuit schematic for a battery-powered radio frequency motion detector, in accordance with various aspects of the present disclosure.

In the following description, reference is made to the accompanying drawings which illustrate several embodiments of the present invention. It is understood that other embodiments may be utilized and mechanical, compositional, structural, electrical operational changes may be made without departing from the spirit and scope of the present disclosure. The following detailed description is not to be taken in a limiting sense, and the scope of the embodiments of the present invention is defined only by the claims of the issued patent.

In various examples, a location such as an office building, home, outdoor space, and/or any other physical location or combination of physical locations may be monitored by one or more motion sensors and/or camera devices of a security system. In various examples, motion sensors and/or camera devices may be battery-powered for ease of installation and to avoid unsightly power cords. In various other examples, camera devices and/or motion sensors may be powered through a wired interface (e.g., through a wall socket). In at least some examples, camera devices may include motion sensors to detect motion. In some examples, upon detection of motion, a camera device may begin capturing and/or streaming video to one or more other devices (e.g., an on location hub and/or a remotely-located server) for storage, display, and/or processing. Advantageously, waiting until motion is detected prior to capturing and/or streaming image data and/or video data may prolong battery life (and minimize power consumption) by capturing video only when movement is detected. In many cases, and particularly in a surveillance context, video segments that do not depict movement may not be of sufficient interest to a user of the camera system to warrant continuous video capture and/or streaming, particularly given that continuous video capture results in a quicker consumption of battery power and more frequent battery replacement. In various examples, video data may refer to one or more sequential frames of image data.

In some examples, insignificant motion may trigger a motion sensor, which may, in turn, cause an action such as initiation of video capture by a camera device even though the video may not be of interest to a user. Accordingly, it may be beneficial to limit the number of such "false positives" where insignificant motion results in triggering of a motion sensor. Triggering of a motion sensor in a camera device may lead to increased power consumption and depletion of battery power. For example, an outdoor camera device may include a passive infrared (PIR) motion sensor with a "field-of-view" (e.g., the area monitored by the motion sensor) that includes a tree outside of a user's home. In the example, the PIR motion sensor may be triggered each time that the wind blows and the leaves of the tree are rustled. The triggering of the motion sensor may, in turn, cause the camera device to capture and/or stream video. In another example, a PIR motion sensor may be triggered by cloud movement and sunlight changes due to passing clouds. Various systems and techniques described herein may be effective to prevent triggering of video capture and/or streaming due to inconsequential motion that is not likely to be of interest to a user.

In various examples, camera devices may include and/or be configured in communication with PIR sensors effective to detect motion in an environment monitored by the PIR sensor and/or by the camera devices. PIR sensors detect infrared (IR) radiation emitted by objects within the PIR sensors' fields-of-view. In some examples, the PIR sensors may be referred to herein as "PIR motion detectors" and "PIR motion sensors". In various examples, a PIR sensor may be effective to determine when an object passes through a PIR sensor's field-of-view by determining differential changes in the IR detected by different sensor regions of a PIR sensor. PIR sensors often include two sensor "halves" and/or multiple sensor regions. A multi-facet lens breaks light received from a scene into multiple regions and projects these regions on to the different halves or regions of the sensor. The sensor integrates the black body radiation detected in the two halves (or in the multiple regions, depending on the sensor) and determines the differential change. The differential change is the difference in detected radiation between the two sensor halves (or between the different regions). If the differential changes caused by an IR-radiating object entering the field-of-view (resulting in a positive differential change in detected IR) and/or leaving the field-of-view (resulting in a negative differential change in detected IR) of the PIR sensor are above a threshold value (typically a tunable threshold referred to as the "sensitivity" of the PIR sensor), the PIR sensor may output a signal indicating that motion has been detected. PIR sensors may be passive in the sense that they may not include any IR light source and may detect radiation emitted from objects within the sensor's field-of-view without subjecting such objects to IR light projected by the sensor. Accordingly, PIR sensors consume relatively little power when in use.

However, PIR sensors have difficulties distinguishing between motion that is likely to be of interest to a user and motion that is relatively inconsequential and unlikely to be of interest to a user. For example, an outdoor PIR may trigger based on sunlight that is filtered through a tree as the wind blows the leaves of the tree and different amounts of radiation are detected by different regions and/or halves of the PIR sensor. Additionally, in scenarios where the target objects to be detected are people at relatively short distances (e.g., a PIR sensor in a video-enabled doorbell camera), large, non-target objects at greater distances, like cars passing on a street, can cause false triggering of the PIR sensor. Additionally, PIR sensors often have difficulty detecting motion when the motion is directly toward or away from the PIR sensor, as the radiation from such objects may not pass between different sensor halves and/or sensor regions and thus may not trigger the PIR sensor. To account for this difficulty, the sensitivity of the PIR sensor may be increased, which in turn, may lead to increased false triggering due to distant non-target motion.

To help eliminate false triggering in PIR motion-sensing systems that are not highly power constrained, a secondary form of motion sensing may be used. For example, secondary radio frequency (RF) motion detectors and video analytics in camera systems may be used to corroborate detection of motion by a PIR sensor. However, in battery-operated cameras, video analytics may consume a significant amount of power and may thereby significantly shorten battery life in some cases. Additionally RF motion sensors typically require line power and are therefore are typically unsuitable for battery-powered devices. Described herein are architectures for RF motion sensors for reduced power consumption for use in battery-operated devices (such as security cameras).

RF motion sensors may use the Doppler effect to determine movement in an environment. Doppler radar mixes a transmitted radio signal with a signal from an antenna that has received the transmitted signal after it has reflected off of surfaces and/or objects within the environment (e.g., an environment external to the RF motion sensor that is being monitored by the RF motion sensor). In a Doppler radar, the transmitted and received signals are inputs to an RF mixer that multiplies the two inputs together. The result of this multiplication is an output signal that, in the frequency domain, includes a signal component at the sum of the two input frequencies (a "sum component signal") and a signal component at the difference of the two input frequencies (a "difference component signal"). By measuring the amplitude and frequency of difference component signal of the two mixed input frequencies, the movement of objects in the field of the antennas can be detected. Traditional RF motion sensors continuously transmit signals and determine Doppler shifts for detection of movement. Such systems may draw a few milliamperes of current. A constant current draw of a few milliamperes (e.g., 1-10 milliamperes) renders such RF motion sensors impractical for use in battery-operated devices, as the batteries may be quickly depleted by the RF motion sensor.

Accordingly, an RF motion sensor architecture is described herein that consumes significantly less power relative to previous architectures allowing for RF motion sensing in battery-powered devices, such as in motion-triggered, battery-powered security cameras. Generally, an RF motion detection circuit exhibiting squegging oscillation is used in conjunction with a microcontroller. "Squegging" refers to a self-quenching oscillating signal. Generally, in a radio receiver exhibiting squegging oscillation, the sensitivity of the receiver rises during a build-up phase of the oscillation. During the build up phase, the amplitude of oscillation of an oscillating signal increases. In other words, the amplitude increases for each cycle of the oscillating signal during build up. In a squegging oscillator, the oscillation of the signal is unstable and the oscillation collapses (e.g., is quenched—ceasing oscillation) when the operation point no longer fulfills the Barkhausen stability criterion. In other words, during the quenching phase, the amplitude of the oscillation decreases. Eventually, the squegging oscillator returns to an initial non-oscillating state and the cycle begins again. The instability of the unstable, squegging oscillator causes oscillation to increase until the Barkhausen stability criterion is no longer met and thereafter to decrease. In the RF motion detection circuit depicted in FIG. 1, each voltage pulse of pulsed voltage source 102 may be effective to generate an unstable oscillating signal (e.g., a squegging signal), where the oscillation of the signal periodically increases and decreases over time due to the RF characteristics of the external environment that is being monitored by the RF motion detection circuit.

In various examples, the microcontroller or another stable voltage source provides a pulsed voltage (e.g., a voltage pulse) used to turn on the RF motion sensor for brief periods of time (e.g., a voltage pulse for periods of 10-100 μs every 0.1 seconds, 0.2 seconds, 0.05 seconds, or some other suitable amount of time). For example, the pulsed voltage may be supplied at a frequency of between 5 and 20 Hz or any other suitable frequency. A voltage representing the difference component signal of the mixed RF signals (e.g., the transmitted and received signals) is sampled by an analog to digital converter (ADC). If the change in voltage between a first and second sample is larger than a preselected threshold, motion may be deemed to have occurred in the environment and the microcontroller may output a signal indicating motion. The squegging oscillation of the circuit architecture allows for sensitive detection of motion even when the circuit is powered only for brief periods of time. Various algorithms can also be used to analyze a plurality of samples to discriminate between desired motion events and interference from other radio sources and motion that should be ignored. Additionally, a plurality of voltages may be determined over time in order to establish voltage threshold used to characterize motion in the particular environment of the RF motion detector. Additionally, in at least some examples, certain frequencies and/or ranges of frequencies may be rejected (e.g., may be ignored) when detecting motion in the RF environment. For example, the frequencies related to operation of a fan in the environment may be ignored to prevent the fan causing a false triggering of the motion detector.

In various examples, the sampled voltages from the RF motion detector described herein may be jointly considered with samples from a PIR detector (or other motion detector) in order to detect motion. In a battery-powered security camera context, capture of video may be triggered upon detection of motion. The use of brief samples of the RF motion detectors described herein may be used to supplement PIR detectors that suffer from false triggering. For example, a PIR detector triggering may cause the RF motion detector to begin pulsing to effectively corroborate the detection of motion by the PIR detector. In some further examples, if either the RF motion detector or the PIR detector is triggered, motion may be detected.

FIG. 1 depicts an example circuit 100 for a battery-powered radio frequency motion detector, in accordance with various aspects of the present disclosure. A transistor Q1 is used to control current flow. Pulsed voltage source 102 supplies stable voltage pulses. Pulsed voltage source 102 may be controlled by and/or may be a part of microcontroller 106 or other processor/controller of circuit 100 such that the pulsed voltage source 102 supplies stable voltage pulses at predetermined time intervals. Pulsed voltage source 102 may periodically supply a voltage pulse (e.g., for periods of 10-100 μs every 0.1 seconds). Pulsed voltage source 102 may supply pulses of 3.3V or of some other stable voltage. During the pulse, the voltage at node 114 is high and transistor Q1 is turned on. In turn, antenna 104 may output (e.g., transmit) an RF signal. The output RF signal may be mixed with a received RF signal representing the transmitted signal after being broadcast to the surrounding environment and received by antenna 104 or another antenna of circuit 100.

In various examples, when pulsed voltage source 102 is supplying a voltage pulse, antenna 104 may emit a periodic bursts of RF energy at a first frequency. In the example circuit depicted in FIG. 1, the first frequency may be 3.2 GHz (+/−10%). Although, the circuit 100 is theoretically stable, coupling between the emitter and base of Q1 may cause circuit 100 to periodically generate a 3.2 GHz oscillation that then quenches itself. The periodic building and quenching of oscillation occurs at roughly 20 MHz (e.g., the "squegging frequency") in response to the voltage pulse. The circuit is not crystal controlled so each pulse of 3.2 GHz oscillation may slightly vary in frequency. The unstable circuit 100 may be periodically enabled for only 100 μs every 0.1 seconds. Thus, there may be 100 μs long bursts of a 3.2 GHz signal amplitude modulated by a 20 MHz oscillation every 0.1 seconds. The 20 MHz modulation may cause spreading of the 3.2 GHz signal such that the bandwidth of the emitted signal is around 100 MHz (e.g., +/−10%). The radiated power may be a few milliwatts. Changing the values of resistor R9 and capacitors C12 and C14 may be effective to change the squegging frequency to other values, as desired.

Resistor R8 and capacitor C9 may be effective to filter out the 20 MHz oscillating signal to generate the difference component signal of the mixed input signals (e.g., the signals transmitted and received by antenna 104 (or another antenna)). The amplitude of the difference component signal may be detected as a voltage across resistor R7 (e.g., an output voltage). The voltage may be input to ADC 108 to generate a digital signal that, in turn, may be input to microcontroller 106. Although separately depicted in FIG. 1, in some examples, ADC 108 may be integrated in microcontroller 106. In various examples, the 3.3 volts depicted at voltage source 112 may be coupled to microcontroller 106 and may supply power to microcontroller 106. In some examples, the voltage source supplying the 3.3 volts (or some other voltage) may be a constant voltage source (e.g., a voltage source configured to supply a constant voltage). In various examples, if the difference value in voltage between two voltages sampled across resistor R7 (e.g., between consecutive or non-consecutive samples) exceeds a threshold value (e.g., a threshold difference value), motion may be detected.

Microcontroller 106 may be effective to generate a motion detection signal that may be used to trigger one or more actions upon detection of motion. For example, microcontroller 106 may trigger a camera to initiate capture of video data and/or an audio system including a microphone to begin capturing audio data. As previously described, in various example embodiments, upon detection of motion using the RF circuit 100, the output of a PIR motion detector 140 coupled to the microcontroller 106 may be sampled to determine whether the PIR motion detector 140 also detects motion. In various further examples, upon detection of motion by microcontroller 106 the frequency of the voltage pulses supplied by pulsed voltage source 102 may be increased to corroborate that motion of interest is occurring within the proximate environment.

In various examples, the voltage across resistor R7 may be sampled at the same time relative to the voltage pulse provided by pulsed voltage source 102. In some examples, the voltage pulse may be provided by pulsed voltage source 102 at 1-20 Hz to drive the node 114 to a high voltage. The voltage over R7 may be sampled at a precise time following the pulse (e.g., 100 μs or some other suitable value). The voltage over R7 may be sampled prior to the RF characteristics of the circuit reaching a steady state as the transient state of the circuit is highly repeatable as long as the delay between the initiation of the pulse voltage and the sampling is the same during each sampling. The microcontroller 106 may turn off the pulsed voltage following the sampling of the voltage at R7. In various examples, the microcontroller 106 may sample the PIR output. In an example implementation, the microcontroller 106 may detect motion when a current sample (e.g., output voltage) of either the PIR motion detector 140 and/or the RF motion detection circuit differ by more than a threshold amount relative to a previous sample (e.g., a previous consecutive sample).

In various examples, if microcontroller 106 detects a voltage change over R7 between two samples that exceeds the predefined threshold for detecting motion, the rate of voltage pulses and sampling may be increased for a period of time to allow further qualification of the motion event. The increase in sampling may reduce the risk of aliasing and may provide additional detail about the motion (e.g., the speed of the motion and/or the direction). In various examples, the antenna(s) used in the RF circuit 100 may be highly directional to limit triggering in areas of the environment that are not being monitored.

Figure 2A:
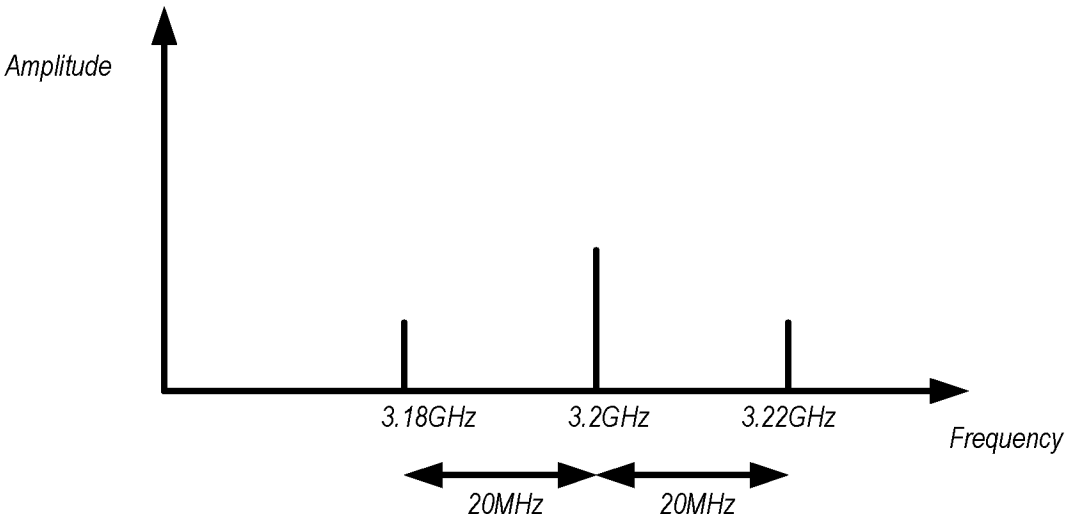
FIG. 2A depicts the radio frequency characteristics of the battery-powered radio frequency motion detector circuit of FIG. 1, in accordance with various embodiments of the present disclosure.

FIG. 2A depicts the radio frequency characteristics of the battery-powered radio frequency motion detector circuit 100 of FIG. 1, in the frequency domain, in accordance with various embodiments of the present disclosure. The circuit 100, during a pulse of pulsed voltage source 102, exhibits a carrier signal at 3.2 GHz and side components at +/−20 MHz (e.g., at 3.18 GHz and at 3.22 GHz). Different component part values of the various resistors and capacitors shown in FIG. 1 may result in different RF characteristics apart from what is depicted in FIG. 2. Although in FIG. 2 single peaks are shown at 3.18 GHz and at 3.22 GHz, multiple lobes may be present for the circuit 100 as the build up and quenching of the squegging oscillator is not purely sinusoidal. In at least some examples, the signal component at 3.18 GHz may be the difference component signal of the mixed input signals (e.g., signals transmitted and received by antenna 104 or another antenna) and may be detected as a voltage across resistor R7 from FIG. 1. Multiplication of the two input signals (e.g., of mathematical representations of the two input signals), referred to as "mixing", generates two component frequencies in the frequency domain—a first signal component at the sum of the two input frequencies and a second signal component at the difference of the two input frequencies. Over particular regions of current through transistor Q1, circuit 100 may oscillate. However, during oscillation, the low frequency conditions may change and may build until the oscillation is no longer viable and the oscillation collapses (or "quenches"). The building and quenching of the oscillation repeats during the voltage pulse from pulsed voltage source 102.

The unstable oscillation of the circuit 100 provides exponential growth of the oscillation providing sensitivity to the circuit 100. A small change in the circuit when the signal is in a low energy state leads to a large difference in energy when the oscillation builds.

In various examples, if motion is detected in an environment monitored by a motion sensor such as a PIR sensor and/or the RF motion detection circuit described above, the triggered motion sensor may provide an indication that motion has been detected. For example, in some embodiments, the RF motion detection circuit and/or a microcontroller may send a signal to one or more camera devices associated with the motion sensor. The signal may be effective to cause the camera device(s) to begin capturing image data and/or video data. For example, a RF motion sensor and a camera device may be situated in a particular room of a building. If the RF motion sensor is triggered (e.g., due to a human walking through the room), the RF motion sensor may send a signal to the camera device indicating that motion has been detected by the RF motion sensor. In response to receipt of the signal from the RF motion sensor, the camera may be configured to begin capturing video. In various examples, the camera device may include a wireless and/or a wired transmitter and may send the captured video (e.g., may "stream" the video) to one or more other devices for playback, processing, and/or storage. For example, the camera device may stream the video to a mobile device of a user associated with the building and/or the room of the building. In some other examples, the camera device may send the video to a central processing device that may be effective to take one or more actions such as storing the video data in one or more memories, processing the video data, sending the video data to one or more other devices, and/or sending an indication or alert indicating that motion has been detected in the environment monitored by the camera device and/or providing optional access to video captured by the camera device. In various examples, the central processing device may be located within the same building or grouping of buildings as the camera device(s); however, in some other examples, the central processing device may be remotely located from the camera device(s) and may communicate with the camera device(s) over a wide area network (WAN) such as the Internet.

In at least some examples, motion sensors, such as PIR sensor(s) and/or RF motion sensors, may be integrated into a housing of the camera device(s). However, in other examples, motion sensors may be separate from the camera device(s) and may communicate with the camera device(s) and/or with a central processing device configured in communication with the camera(s) using a wired and/or a wireless communication technology. In still other examples, the RF motion sensor may be a standalone motion sensor effective to detect motion in an environment. For example, the RF motion sensor(s) may communicate with the camera device(s) and/or with a central processing device via a short-range communication protocol such as Bluetooth® or Bluetooth® Low Energy (BLE). In various other examples, the RF motion sensor(s) may communicate with the camera device(s) and/or with a central processing device using a wireless local area network (WLAN) using, for example, a version of the IEEE 802.11 standard.

In at least some examples, the RF motion sensor(s) and/or the camera device(s) may be battery powered. However, in some examples, the PIR sensor(s) and/or the camera device(s) may be battery powered and/or powered using a wired connection to a power source (e.g., a wall socket). In various examples, a central processing device (or multiple central processing devices) may be effective to communicate with the camera device(s) using a wired and/or wireless connection. For example, the central processing device may communicate with the camera device(s) using a wireless network such as a WLAN via the 900 MHz band. In some examples, the central processing device and/or the camera devices may be effective to receive user requests (e.g., from a user mobile device and/or from a companion application on a user mobile device) to access image data and/or video data that is accessible via the central processing device and/or to cause one or more camera devices to begin capturing and/or streaming video. For example, the central processing device may receive a request from a mobile device (e.g., a mobile device authenticated to the central processing device) for particular video data captured by a particular camera device at a particular time. In the example, the central processing device may stream the video to the authenticated mobile device. In some other examples, an authenticated mobile device may request a live video feed from one or more camera device(s). In the example, the central processing device may be effective to control the relevant camera device(s) to begin capturing video data. The central processing device may be effective to have the relevant camera device(s) stream the video data to the requesting mobile device. In other embodiments, the relevant camera device(s) may send the video data to the central processing device which may, in turn, stream the video to the requesting mobile device (after video processing, for example). In at least some examples, the central processing device may be powered by a wired connection to a wall outlet or other power source. In other examples, an authenticated mobile device may communicate directly with the one or more camera devices.

Figure 2B:
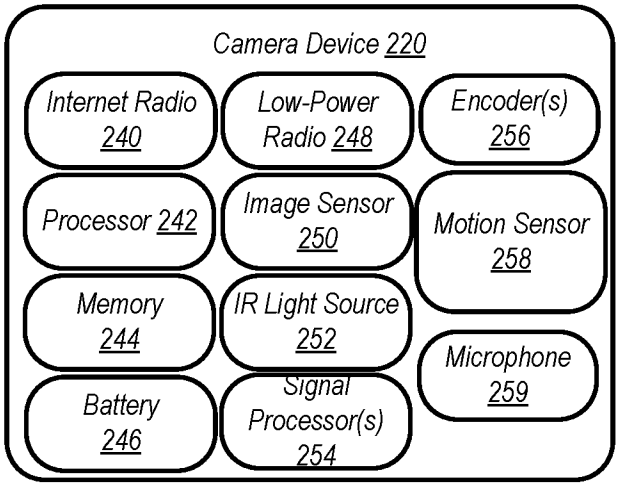
FIG. 2B depicts an example camera device that may be used in accordance with various aspects of the present disclosure.

FIG. 2B depict an example camera device 220 that may be used in accordance with various aspects of the present disclosure. In various examples, camera device 220 may include additional components apart from what is shown. Additionally, in various examples, one or more components of camera device 220 depicted in FIG. 2B may be omitted. Accordingly, the camera device 220 depicted in FIG. 2B is provided by way of example only. In various examples, camera device 220 may comprise an internet radio 240 (e.g., a WiFi radio). In various examples, camera device 220 may use internet radio 240 to send capture video data, image data, and/or audio data (e.g., captured by microphone 259) to one or more other computing devices for display, storage, and/or processing. For example, camera device 220 may use internet radio 240 to send video data to a video processing device. A video processing device may, in turn, send video data, image data, and/or audio data received from camera device 220 to one or more other computing devices. For example, a video processing device may send video data to a mobile device of a user via a base station or hub configured in communication with camera device 220.

Camera device 220 may further comprise one or more processors (e.g., microcontroller 106 of FIG. 1). For example, camera device may comprise processor 242. Additionally, camera device 220 may comprise a computer-readable non-transitory memory 244. In various examples, the memory 244 may store instructions that may be executed by the processor to cause the processor to be operable to perform one or more of the operations described herein. Camera device 220 may comprise a battery 246. Battery 246 may be a lithium-ion battery, a nickel cadmium battery, or any other suitable type of battery. In various other examples, camera device 220 may be powered via an external power source. Camera device 220 may further comprise an image sensor 250 effective to capture image and video data. In various examples, image sensor 250 may be a complimentary metal oxide semiconductor (CMOS) sensor or a charge-coupled device (CCD) image sensor. In various examples, camera device 220 may comprise an IR light source 252 so that the camera device 220 can capture infrared images and/or video. Additionally, camera device 220 may comprise motion sensor 258 which may be one or more of a PIR motion sensor and/or an RF motion sensor, as described herein. Camera device 220 may comprise an encoder 256 effective to encode image data and/or video data into a compressed representation for transmission to one or more other devices. Camera device 220 may include a low-power radio 248 such as a Bluetooth radio effective to send and/or receive data. Camera device 220 may include a signal processor 254 effective to perform various signal processing functionality such as the sampling and analog to digital conversion described above in reference to FIG. 1. In various examples, signal processor 254 may be integrated into microcontroller 106.

Figure 3:
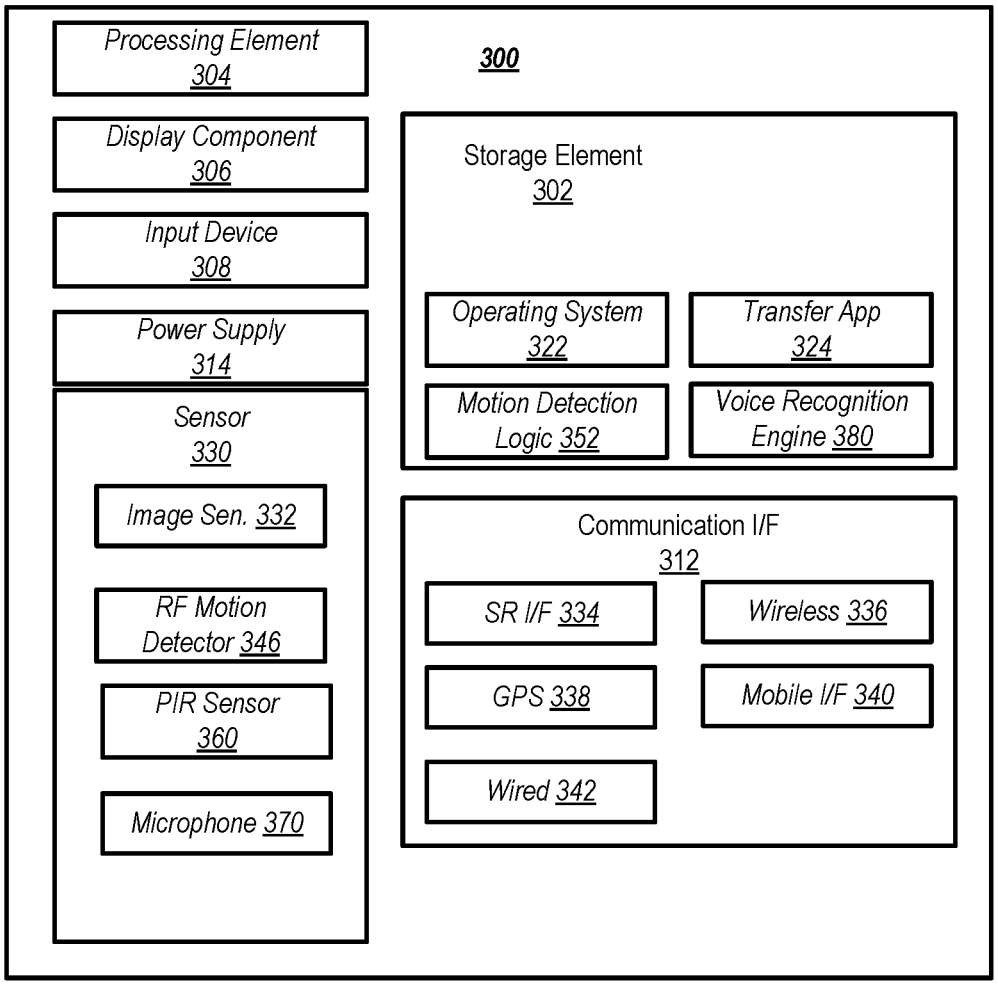
FIG. 3 is a block diagram showing an example architecture of a computing device that may be used in accordance with various aspects of the present disclosure.

FIG. 3 is a block diagram showing an example architecture 300 of a device, such as microcontroller 106 and/or a battery-powered camera device and/or other computing device. It will be appreciated that not all devices will include all of the components of the architecture 300 and some user devices may include additional components not shown in the architecture 300. The architecture 300 may include one or more processing elements 304 for executing instructions and retrieving data stored in a storage element 302. The processing element 304 may comprise at least one processor. Any suitable processor or processors may be used. For example, the processing element 304 may comprise one or more digital signal processors (DSPs). The storage element 302 can include one or more different types of memory, data storage, or computer-readable storage media devoted to different purposes within the architecture 300. For example, the storage element 302 may comprise flash memory, random-access memory, disk-based storage, etc. Different portions of the storage element 302, for example, may be used for program instructions for execution by the processing element 304, storage of images or other digital works, and/or a removable storage for transferring data to other devices, etc.

The storage element 302 may also store software for execution by the processing element 304. An operating system 322 may provide the user with an interface for operating the user device and may facilitate communications and commands between applications executing on the architecture 300 and various hardware thereof. A transfer application 324 may be configured to send and/or receive image and/or video data to and/or from other devices (e.g., between one or more camera devices and a hub or other local or remote video processing device and/or other computing device. In some examples, the transfer application 324 may also be configured to upload the received images to another device that may perform video processing (e.g., a mobile device or another computing device). Additionally, the transfer application 324 may be configured to send alerts and/or notifications to one or more mobile computing devices associated with a camera system or other system used in accordance with the various techniques described herein. For example, an alert may be sent to a mobile device of a person associated with a home or building when a camera device comprising an RF motion detector (e.g., RF motion detector 346 including the circuit 100) detects motion within an environment monitored by the camera device. The alert and/or notification may provide an option for a live stream of video and/or a portion of recorded video captured by the camera device detecting the motion.

In various examples, storage element 302 may store motion detection logic 352. Motion detection logic 352 may control initiation of video data capture, audio data capture, image data capture, and/or streaming of video data, image data, and/or audio data. In some examples, motion detection logic 352 may be hardwired (e.g., in an application specific integrated circuit (ASIC)), while in other examples, motion detection logic 352 may be configurable either through computer executable instructions executed by processing element 304, a programmable circuit (e.g., a field-programmable gate array (FPGA)) or some combination thereof. In various examples, motion detection logic 352 may control which motion sensors are used to trigger the initiation of video capture, image capture, and/or audio capture, and/or of streaming video, audio, and/or image data. For example, a logical AND operation may be used to initiate streaming when both an integrated RF motion sensor and PIR motion sensor are used to detect motion. Additionally, the motion detection logic 352 may be used to set the threshold voltages used by microcontroller 106 to determine motion based on Doppler shift.

When implemented in some user devices, the architecture 300 may also comprise a display component 306. The display component 306 may comprise one or more light-emitting diodes (LEDs) or other suitable display lamps. Also, in some examples, the display component 306 may comprise, for example, one or more devices such as cathode ray tubes (CRTs), liquid-crystal display (LCD) screens, gas plasma-based flat panel displays, LCD projectors, raster projectors, infrared projectors or other types of display devices, etc.

The architecture 300 may also include one or more input devices 308 operable to receive inputs from a user. The input devices 308 can include, for example, a push button, touch pad, touch screen, wheel, joystick, keyboard, mouse, trackball, keypad, light gun, game controller, or any other such device or element whereby a user can provide inputs to the architecture 300. These input devices 308 may be incorporated into the architecture 300 or operably coupled to the architecture 300 via wired or wireless interface. In some examples, architecture 300 may include a microphone 370 for capturing sounds, such as voice commands, and/or audio data. Voice recognition engine 380 may interpret audio signals of sound captured by microphone 370. In some examples, voice recognition engine 380 may listen for a "wake word" to be received by microphone 370. Upon receipt of the wake word, voice recognition engine 380 may stream audio to a voice recognition server for analysis. In various examples, voice recognition engine 380 may stream audio to external computing devices via communication interface 312.

When the display component 306 includes a touch-sensitive display, the input devices 308 can include a touch sensor that operates in conjunction with the display component 306 to permit users to interact with the image displayed by the display component 306 using touch inputs (e.g., with a finger or stylus). The architecture 300 may also include a power supply 314, such as a wired alternating current (AC) converter, a rechargeable battery operable to be recharged through conventional plug-in approaches, a non-rechargeable battery, and/or through other approaches such as capacitive or inductive charging.

The communication interface 312 may comprise one or more wired or wireless components operable to communicate with one or more other user devices. For example, the communication interface 312 may comprise a wireless communication module 336 configured to communicate on a network according to any suitable wireless protocol, such as IEEE 802.11 or another suitable wireless local area network (WLAN) protocol. A short range interface 334 may be configured to communicate using one or more short range wireless protocols such as, for example, near field communication (NFC), Bluetooth, BLE, etc. A mobile interface 340 may be configured to communicate utilizing a cellular or other mobile protocol. A Global Positioning System (GPS) interface 338 may be in communication with one or more earth-orbiting satellites or other suitable position-determining systems to identify a position of the architecture 300. A wired communication module 342 may be configured to communicate according to the USB protocol or any other suitable protocol.

The architecture 300 may also include one or more sensors 330 such as, for example, one or more position sensors, image sensors, and/or motion sensors. An image sensor 332 is shown in FIG. 3. In various examples, the camera device 220 described above in reference to FIGS. 1 and 2 may include one or more image sensors (e.g., image sensor 250 in FIG. 2). Some examples of the architecture 300 may include multiple image sensors 332. For example, a panoramic camera system may comprise multiple image sensors 332 resulting in multiple images and/or video frames that may be stitched and may be blended to form a seamless panoramic output.

Motion sensors may include any sensors that sense motion of the architecture including, for example, PIR sensors 360, and RF motion detector 346. Motion sensors, in some examples, may be used to determine an orientation, such as a pitch angle and/or a roll angle of a camera. A gyro sensor (not shown) may be configured to generate a signal indicating rotational motion and/or changes in orientation of the architecture (e.g., a magnitude and/or direction of the motion or change in orientation). Any suitable gyro sensor may be used including, for example, ring laser gyros, fiber-optic gyros, fluid gyros, vibration gyros, etc. An accelerometer (not shown) may generate a signal indicating an acceleration (e.g., a magnitude and/or direction of acceleration). Any suitable accelerometer may be used including, for example, a piezoresistive accelerometer, a capacitive accelerometer, etc. In some examples, the motion sensors may comprise an RF motion detector 346 which may include circuit 100 of FIG. 1. In various further examples, the motion sensors may include a PIR sensor 360 used to detect motion.

Figure 4:
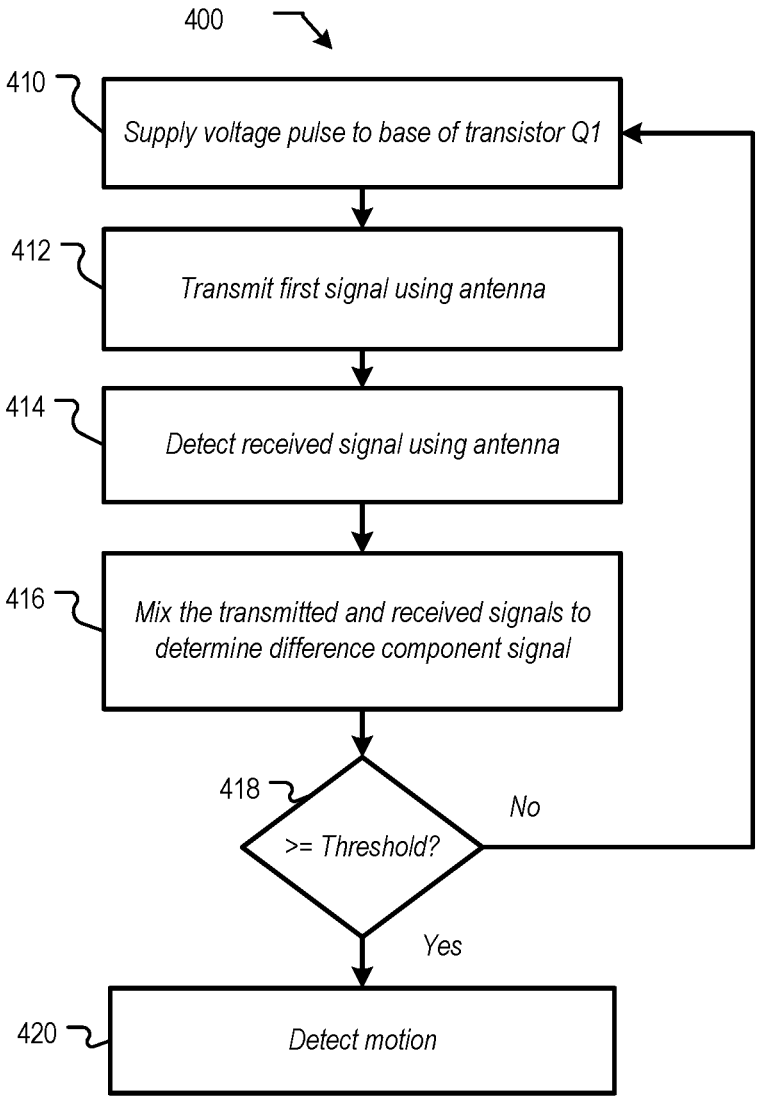
FIG. 4 depicts an example process that may be used to detect motion in a monitored environment, in accordance with various embodiments of the present disclosure.
Figure 5:
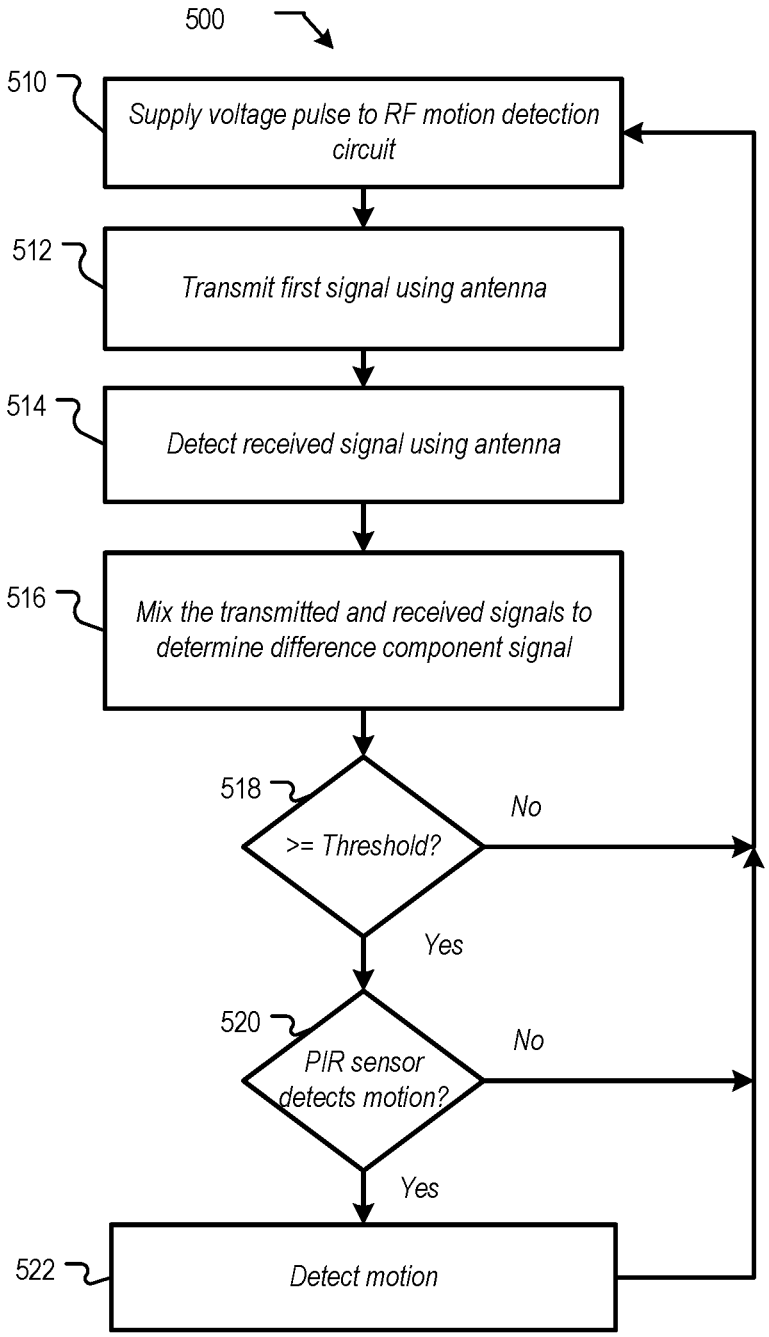
FIG. 5 depicts another example process that may be used to detect motion in a monitored environment, in accordance with various embodiments of the present disclosure.

FIG. 4 depicts an example process 400 that may be used to detect motion in a monitored environment using an RF motion detector, in accordance with various embodiments of the present disclosure. The actions of the process 400 may be controlled, at least in part, by one or more processors executing one or more instructions comprising computer readable machine code. For example, microcontroller 106 and/or by processor 242 of camera device 220 may execute one or more of the instructions. In various examples, the computer readable machine codes may be comprised of instructions selected from a native instruction set of the computing device and/or an operating system of the computing device. Although the various actions of FIGS. 4 and 5 are depicted as occurring sequentially, one or more of the actions depicted in FIGS. 4 and 5 may instead occur simultaneously and/or in different orders apart from what is depicted. In addition, one or more actions depicted in FIGS. 4 and 5 may be omitted in some embodiments.

Process 400 may begin at action 410, "Supply voltage pulse to base of transistor Q1". At action 410, a stable voltage pulse may be supplied to a transistor or other control component configured to cause an RF motion detection circuit to transmit an RF signal using an antenna. For example, pulsed voltage source 102 of FIG. 1 may supply a voltage pulse to the base of transistor Q1 to cause antenna 104 to transmit an RF signal. In various examples, transistor Q1 may be a bipolar junction transistor (BJT) comprising a collector, emitter, and base. In some other examples, transistor Q1 may be implemented as a metal oxide semiconductor field effect transistor (MOSFET) comprising a source, a drain, and a gate.

Processing may continue from action 410 to action 412, "Transmit first signal using antenna". At action 412, a first signal may be transmitted by an antenna. For example, in circuit 100, when transistor Q1 is turned on antenna 104 may transmit an RF signal to the surrounding environment.

Processing may continue from action 412 to action 414, "Detect received signal using antenna". At action 414 an antenna of the RF motion sensor circuit may detect a received signal. As previously described, in various examples, the received signal may be the transmitted signal from action 412 after the transmitted signal has reflected off of various surfaces and objects within an environment monitored by the RF motion sensor.

Processing may continue from action 414 to action 416, "Mix the transmitted and received signals to determine difference component signal". At action 416, the transmitted and received signals may be mixed. Mixing the transmitted and received signals may comprise multiplying the transmitted and received signals to determine the sum and difference components of the two signals. In various examples, the difference component signal may be detected as a voltage across an output resistor of the circuit (e.g., resistor R7 in FIG. 1).

At action 418, a determination may be made as to whether the voltage difference between two samples is greater than or equal to a threshold difference. In various examples, microcontroller 106 may determine whether the voltage difference between two samples is greater than or equal to a threshold voltage difference. If the difference in voltages between two samples is greater than or equal to the threshold voltage difference, motion may be detected at action 420. In various examples, detection of motion may be used to trigger one or more other actions. For example, when microcontroller 106 detects motion at action 420, microcontroller 106 may be effective to turn on an image sensor of a camera to begin capturing and/or streaming video. Conversely, if the voltage difference between two samples is less than the voltage difference threshold, processing may return to action 410 and another voltage pulse may be supplied to the base of transistor Q1 to continue monitoring for motion in the environment using the RF motion detector.

FIG. 5 depicts an example process 500 that may be used to detect motion in a monitored environment using an RF motion detector, in accordance with various embodiments of the present disclosure. At least some of the actions of the process 500 may represent a series of instructions comprising computer readable machine code executable by a processing unit of a computing device, such as by microcontroller 106 and/or processor 242 of camera device 220. In various examples, the computer readable machine codes may be comprised of instructions selected from a native instruction set of the computing device and/or an operating system of the computing device. Again, although the various actions of FIGS. 4 and 5 are depicted as occurring sequentially, one or more of the actions depicted in FIGS. 4 and 5 may instead occur simultaneously and/or in different orders apart from what is depicted. In addition, one or more actions depicted in FIGS. 4 and 5 may be omitted in some embodiments.

Process 500 may begin at action 510, "Supply voltage pulse to RF motion detection circuit". At action 410, a stable voltage pulse may be supplied to a transistor or other control component configured to cause an RF motion detection circuit to transmit an RF signal using an antenna. For example, pulsed voltage source 102 of FIG. 1 may supply a voltage pulse to the base of transistor Q1 to cause antenna 104 to transmit an RF signal.

Processing may continue from action 510 to action 512, "Transmit first signal using antenna". At action 512, a first signal may be transmitted by an antenna. For example, in circuit 100, when transistor Q1 is turned on antenna 104 may transmit an RF signal to the surrounding environment. The RF signal may be amplified based on the squegging oscillation of circuit 100.

Processing may continue from action 512 to action 514, "Detect received signal using antenna". At action 514 an antenna of the RF motion sensor circuit may detect a received signal. As previously described, in various examples, the received signal may be the transmitted signal from action 512 after the transmitted signal has reflected off of various surfaces of objects within an environment monitored by the RF motion sensor.

Processing may continue from action 514 to action 516, "Mix the transmitted and received signals to determine difference component signal". At action 516, the transmitted and received signals may be mixed to determine the sum and difference components of the two signals. In various examples, the difference frequency may be detected as a voltage across an output resistor of the circuit (e.g., resistor R7 in FIG. 1).

At action 518, a determination may be made as to whether the voltage difference between two samples (e.g., between consecutive pulses of the pulsed voltage source 102) is greater than or equal to a threshold voltage difference. In various examples, microcontroller 106 may determine whether the voltage difference between two voltage samples is greater than or equal to the threshold voltage difference. If the voltage difference between two samples is greater than or equal to a threshold voltage difference, an output of a PIR sensor (e.g., PIR motion detector 140) may be sampled at action 520 to determine whether the PIR sensor detects motion. Conversely, if the voltage difference between two samples is less than the voltage difference threshold, processing may return to action 510 and another voltage pulse may be supplied to the RF motion detection circuit to continue monitoring for motion in the environment using the RF motion detector.

If a determination is made that the voltage difference between two samples is greater than or equal to a threshold voltage difference at action 518 and if consecutive PIR sensor samples exhibit a difference that exceeds a PIR sensor threshold, processing may continue to action 522 and motion may be detected. In various examples, detection of motion may be used to trigger one or more other actions. For example, when microcontroller 106 detects motion at action 522, microcontroller 106 may be effective to turn on an image sensor of a camera to begin capturing and/or streaming video. If the PIR sensor does not detect motion, processing may return to action 510 and another voltage pulse may be supplied to the RF motion detection circuit to continue monitoring for motion in the environment using the RF motion detector.

In various examples, the pulse rate for the voltage pulses may be increased after the RF motion detection circuit detects a motion event for a certain period of time (e.g., 1-10 seconds).

Among other potential benefits, a system in accordance with the present disclosure may provide more accurate motion detection in battery operated motion detection systems such as battery powered camera devices configured to initiate video capture based on motion detection. The various techniques described herein may allow power to be supplied to an RF motion detection circuit in short pulses to minimize power consumption. Additionally, due to squegging oscillation exhibited by the circuit, small changes in energy of the received Doppler signal are amplified resulting in a sensitive, low-powered RF motion detection circuit. Without the squegging oscillation explicit mixing components, intermediate frequency stages, and/or amplifiers may be needed in order to impart useful sensitivity to an RF motion detection circuit. The squegging oscillator circuit described herein allows for equivalent circuit performance and sensitivity while reducing the complexity and number of components needed. Additionally, the RF motion detection circuit may be used in conjunction with one or more other motion sensors such as a PIR motion sensor to distinguish between motion events of interest and false positives.

As set forth above, certain methods or process blocks may be omitted in some implementations. The methods and processes described herein are also not limited to any particular sequence, and the blocks or states relating thereto can be performed in other sequences that are appropriate. For example, described blocks or states may be performed in an order other than that specifically disclosed, or multiple blocks or states may be combined in a single block or state. The example blocks or states may be performed in serial, in parallel or in some other manner. Blocks or states may be added to or removed from the disclosed example embodiments.

It will also be appreciated that various items may be stored in memory or on storage while being used, and that these items or portions thereof may be transferred between memory and other storage devices for purposes of memory management and data integrity. Alternatively, in other embodiments some or all of the software modules and/or systems may execute in memory on another device and communicate with the illustrated computing systems via inter-computer communication. Furthermore, in some embodiments, some or all of the systems and/or modules may be implemented or provided in other ways, such as at least partially in firmware and/or hardware, including, but not limited to, one or more application-specific integrated circuits (ASICs), standard integrated circuits, controllers (e.g., by executing appropriate instructions, and including microcontrollers and/or embedded controllers), field-programmable gate arrays (FPGAs), complex programmable logic devices (CPLDs), etc. Some or all of the modules, systems and data structures may also be stored (e.g., as software instructions or structured data) on a computer-readable medium, such as a hard disk, a memory, a network or a portable media article to be read by an appropriate drive or via an appropriate connection. The systems, modules and data structures may also be sent as generated data signals (e.g., as part of a carrier wave or other analog or digital propagated signal) on a variety of computer-readable transmission media, including wireless-based and wired/cable-based media, and may take a variety of forms (e.g., as part of a single or multiplexed analog signal, or as multiple discrete digital packets or frames). Such computer program products may also take other forms in other embodiments. Accordingly, the present invention may be practiced with other computer system configurations.

Although the flowcharts and methods described herein may describe a specific order of execution, it is understood that the order of execution may differ from that which is described. For example, the order of execution of two or more blocks or steps may be scrambled relative to the order described. Also, two or more blocks or steps may be executed concurrently or with partial concurrence. Further, in some embodiments, one or more of the blocks or steps may be skipped or omitted. It is understood that all such variations are within the scope of the present disclosure.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. The various features and processes described above may be used independently of one another, or may be combined in various ways. All possible combinations and subcombinations are intended to fall within the scope of this disclosure.

In addition, conditional language, such as, among others, "can," "could," "might," or "may," unless specifically stated otherwise, or otherwise understood within the context as used, is generally intended to convey that certain embodiments include, while other embodiments do not include, certain features, elements and/or steps.

Although this disclosure has been described in terms of certain example embodiments and applications, other embodiments and applications that are apparent to those of ordinary skill in the art, including embodiments and applications that do not provide all of the benefits described herein, are also within the scope of this disclosure. The scope of the inventions is defined only by the claims, which are intended to be construed without reference to any definitions that may be explicitly or implicitly included in any incorporated-by-reference materials.

What is claimed is:

1. A radio frequency (RF) motion sensing circuit, comprising:

a transistor;

a constant voltage source coupled to a collector of the transistor;

a first antenna coupled to an emitter of the transistor;

an output resistor coupled to the emitter and coupled to a processor;

a microcontroller coupled to the output resistor; and a pulsed voltage source coupled to a base of the transistor, wherein the pulsed voltage source is effective to generate a periodic voltage pulse, the periodic voltage pulse effective to cause a current to flow from the constant voltage source through the collector to the emitter, the current effective to cause the first antenna to transmit a first RF signal having a first frequency;

wherein the first antenna is effective to receive a second RF signal having a second frequency, the second RF signal representing the first RF signal reflected off one or more surfaces in an environment of the RF motion sensing circuit;

wherein the RF motion sensing circuit generates a difference component signal at a third frequency, wherein the third frequency is the difference between the first frequency and the second frequency;

wherein a voltage across the output resistor during the periodic voltage pulse corresponds to the difference component signal;

the microcontroller effective to:

determine a first voltage across the output resistor sampled during a first pulse of the pulsed voltage source;

determine a second voltage across the output resistor sampled during a second pulse of the pulsed voltage source;

determine a difference value between the first voltage and the second voltage;

determine that the difference value exceeds a threshold value indicating motion in the environment; and generate a motion detection signal effective to cause a camera device to initiate video capture.

2. The RF motion sensing circuit of claim 1, wherein the difference value is a first difference value and the threshold value is a first threshold value, further comprising:

a passive infrared (PIR) sensor coupled to the microcontroller, wherein the microcontroller is further effective to:

determine a second difference value between a first voltage of the PIR sensor sampled at a first time and a second voltage of the PIR sensor sampled at a second time; and determine that the second difference value exceeds a second threshold value indicating motion in the environment, wherein the motion detection signal is generated based on the first difference value exceeding the first threshold value and the second difference value exceeding the second threshold value.

3. The RF motion sensing circuit of claim 2, wherein the microcontroller is further effective to increase a frequency of the periodic voltage pulse in response to the second difference value exceeding the second threshold value.

4. A method comprising:

receiving, at a radio frequency (RF) motion detection circuit, a first voltage pulse;

outputting, by the RF motion detection circuit based at least in part on the first voltage pulse, a first RF signal, wherein the first voltage pulse causes an unstable oscillating signal to be generated by the RF motion detection circuit;

receiving, by the RF motion detection circuit, a second RF signal, the second RF signal being the first RF signal reflected from an environment external to the RF motion detection circuit;

generating, by the RF motion detection circuit, a difference component signal by mixing the first RF signal and the second RF signal; and generating a first output voltage, the first output voltage representing the difference component signal, wherein the difference component signal is amplified by the unstable oscillating signal.

5. The method of claim 4, further comprising:

determining a difference value between the first output voltage and a second output voltage of the RF motion detection circuit, the second output voltage sampled at a different time relative to the first output voltage;

determining that the difference value exceeds a threshold value, the threshold value indicating motion in the environment; and sending a signal to a camera device, wherein the signal is effective to cause the camera device to initiate capture of video data.

6. The method of claim 4, further comprising:

generating, by the RF motion detection circuit, the unstable oscillating signal in response to the first voltage pulse, wherein an amplitude of the unstable oscillating signal increases over a first period of time and decreases over a second period of time.

7. The method of claim 4, further comprising:

receiving, at the RF motion detection circuit, a second voltage pulse from a pulsed voltage source of the RF motion detection circuit, wherein the pulsed voltage source is effective to send voltage pulses to the RF motion detection circuit at predetermined time intervals;

outputting, by the RF motion detection circuit based at least in part on the second voltage pulse, a third RF signal;

receiving, by the RF motion detection circuit, a fourth RF signal, the fourth RF signal being the third RF signal reflected from the environment;

generating, by the RF motion detection circuit, a second difference component signal by mixing the third RF signal and the fourth RF signal;

generating a second output voltage of the RF motion detection circuit, the second output voltage representing the second difference component signal;

determining a difference value between the first output voltage and the second output voltage;

determining that the difference value exceeds a threshold value; and generating a signal indicating that motion is detected in the environment.

8. The method of claim 4, further comprising:

determining a first difference value between the first output voltage and a second output voltage of the RF motion detection circuit, the second output voltage sampled at a different time relative to the first output voltage;

determining that the first difference value exceeds a first threshold value, the first threshold value indicating motion in the environment;

in response to determining that the first difference value exceeds the first threshold value:

determining a third output voltage received from a passive infrared (PIR) sensor;

determining a fourth output voltage received from the PIR sensor;

determining a second difference value between the third output voltage and the fourth output voltage;

determining that the second difference value exceeds a second threshold value; and sending a signal to a camera device, wherein the signal is effective to cause the camera device to initiate capture of video data.

9. The method of claim 4, further comprising:

receiving, from a passive infrared (PIR) sensor, a second output voltage;

receiving, from the PIR sensor, a third output voltage;

determining a difference value between the second output voltage and the third output voltage;

determining that the difference value exceeds a threshold value; and increasing a frequency at which a voltage source outputs a pulsed voltage to the RF motion detection circuit.

10. The method of claim 4, further comprising:

receiving, by the RF motion detection circuit, a second voltage pulse;

outputting, by the RF motion detection circuit based at least in part on the second voltage pulse, a third RF signal;

receiving, by the RF motion detection circuit, a fourth RF signal, the fourth RF signal being the third RF signal reflected from the environment;

generating a second difference component signal by mixing the third RF signal and the fourth RF signal;

generating a second output voltage representing the second difference component signal;

determining a first difference value between the first output voltage and the second output voltage;

determining that the first difference value exceeds a first threshold value;

receiving, from a passive infrared (PIR) sensor, a third output voltage;

receiving, from the PIR sensor, a fourth output voltage;

determining a second difference value between the third output voltage and the fourth output voltage;

determining that the second difference value does not exceed a second threshold value; and sending a signal to a camera device, wherein the signal is effective to cause the camera device to initiate capture of video data.

11. The method of claim 4, further comprising:

receiving, by the RF motion detection circuit, a second voltage pulse;

outputting, by the RF motion detection circuit based at least in part on the second voltage pulse, a third RF signal;

receiving, by the RF motion detection circuit, a fourth RF signal, the fourth RF signal being the third RF signal reflected from the environment;

generating a second difference component signal by mixing the third RF signal and the fourth RF signal;

generating a second output voltage representing the second difference component signal;

determining a first difference value between the first output voltage and the second output voltage;

determining that the first difference value does not exceed a first threshold value;

receiving, from a passive infrared (PIR) sensor, a third output voltage;

receiving, from the PIR sensor, a fourth output voltage;

determining a second difference value between the third output voltage and the fourth output voltage;

determining that the second difference value exceeds a second threshold value; and sending a signal to a camera device, the signal effective to cause the camera device to initiate capture of video data.

12. The method of claim 4, further comprising:

receiving, by the RF motion detection circuit, a second voltage pulse;

outputting, by the RF motion detection circuit based at least in part on the second voltage pulse, a third RF signal;

receiving, by the RF motion detection circuit, a fourth RF signal, the fourth RF signal being the third RF signal reflected from the environment;

generating a second difference component signal by mixing the third RF signal and the fourth RF signal;

generating a second output voltage representing the second difference component signal;

determining a first difference value between the first output voltage and the second output voltage;

determining that the first difference value exceeds a first threshold value;

receiving, from a passive infrared (PIR) sensor, a third output voltage;

receiving, from the PIR sensor, a fourth output voltage;

determining a second difference value between the third output voltage and the fourth output voltage;

determining that the second difference value does not exceed a second threshold value; and sending a signal to a camera device, the signal effective to cause the camera device to initiate capture of video data.

13. A motion detection system comprising:

a radio frequency (RF) motion detection circuit;

at least one processor effective to send a first voltage pulse to the RF motion detection circuit, wherein the first voltage pulse is effective to cause the RF motion detection circuit to:

transmit a first RF signal using an antenna of the RF motion detection circuit;

generate an unstable oscillating signal;

receive a second RF signal, the second RF signal being the first RF signal reflected from an environment external to the RF motion detection circuit;

generate a difference component signal by mixing the first RF signal and the second RF signal, wherein the difference component signal is amplified by the unstable oscillating signal; and generate a first output voltage, the first output voltage representing the difference component signal.

14. The motion detection system of claim 13, wherein an amplitude of the unstable oscillating signal increases over a first period of time and decreases over a second period of time.

15. The motion detection system of claim 13, wherein the at least one processor is effective to send a second voltage pulse to the RF motion detection circuit, wherein the second voltage pulse is effective to cause the RF motion detection circuit to:

output a third RF signal using the antenna;

receive a fourth RF signal, the fourth RF signal being the third RF signal reflected from the environment;

generate a second difference component signal by mixing the third RF signal and the fourth RF signal; and generating a second output voltage representing the second difference component signal;

the at least one processor further effective to:

determine a difference value between the first output voltage and the second output voltage;

determine that the difference value exceeds a threshold value; and generate a signal indicating that motion is detected in the environment.

16. The motion detection system of claim 13, wherein the at least one processor is further effective to:

determine a first difference value between the first output voltage and a second output voltage of the RF motion detection circuit, the second output voltage sampled at a different time relative to the first output voltage;

determine that the first difference value exceeds a first threshold value, the first threshold value indicating motion in the environment;

in response to determining that the first difference value exceeds the first threshold value the at least one processor is further effective to:

determine a third output voltage received from a passive infrared (PIR) sensor;

determine a fourth output voltage received from the PIR sensor;

determine a second difference value between the third output voltage and the fourth output voltage;

determine that the second difference value exceeds a second threshold value; and send a signal to a camera device, wherein the signal is effective to cause the camera device to initiate capture of video data.

17. The motion detection system of claim 13, wherein the at least one processor is further effective to:

receive a second output voltage from a passive infrared (PIR) sensor; and receive a third output voltage from a PIR sensor;

determine a difference value between the second output voltage and the third output voltage;

determine that the difference value exceeds a threshold value; and increase a frequency at which a voltage source outputs a pulsed voltage to the RF motion detection circuit.

18. The motion detection system of claim 13, further comprising a passive infrared (PIR) sensor, wherein the at least one processor is further effective to send a second voltage pulse to the RF motion detection circuit, wherein the second voltage pulse is effective to cause the RF motion detection circuit to:

output a third RF signal using the antenna;

receive a fourth RF signal, the fourth RF signal being the third RF signal reflected from the environment;

generate a second difference component signal by mixing the third RF signal and the fourth RF signal; and generate a second output voltage, the second output voltage representing the second difference component signal;

the at least one processor further effective to:

determine a first difference value between the first output voltage and the second output voltage; and determine that the first difference value exceeds a first threshold value;

the PIR sensor effective to:

determine a third output voltage; and determine a fourth output voltage;

the at least one processor further effective to:

determine a second difference value between the third output voltage and the fourth output voltage;

determine that the second difference value does not exceed a second threshold value; and send a signal to a camera device, wherein the signal is effective to cause the camera device to initiate capture of video data.

19. The motion detection system of claim 13, further comprising a passive infrared (PIR) sensor, wherein the at least one processor is further effective to send a second voltage pulse to the RF motion detection circuit, wherein the second voltage pulse is effective to cause the RF motion detection circuit to:

output a third RF signal using the antenna;

receive a fourth RF signal, the fourth RF signal being the third RF signal reflected from the environment;

generate a second difference component signal by mixing the third RF signal and the fourth RF signal; and generate a second output voltage representing the second difference component signal;

the at least one processor further effective to:

determine a first difference value between the first output voltage and the second output voltage; and determine that the first difference value does not exceed a first threshold value;

the PIR sensor effective to:

determine a third output voltage; and determine a fourth output voltage;

the at least one processor further effective to:

determine a second difference value between the third output voltage and the fourth output voltage;

determine that the second difference value exceeds a second threshold value; and send a signal to a camera device, the signal effective to cause the camera device to initiate capture of video data.

20. The motion detection system of claim 13, further comprising a passive infrared (PIR) sensor, wherein the at least one processor is further effective to send a second voltage pulse to the RF motion detection circuit, wherein the second voltage pulse is effective to cause the RF motion detection circuit to:

output a third RF signal using the antenna;

receive a fourth RF signal, the fourth RF signal being the third RF signal reflected from the environment;

generate a second difference component signal by mixing the third RF signal and the fourth RF signal; and generate a second output voltage representing the second difference component signal;

the at least one processor further effective to:

determine a first difference value between the first output voltage and the second output voltage; and determine that the first difference value exceeds a first threshold value;

the PIR sensor effective to:

determine a third output voltage; and determine a fourth output voltage;

the at least one processor further effective to:

determine a second difference value between the third output voltage and the fourth output voltage;

determine that the second difference value does not exceed a second threshold value; and send a signal to a camera device, the signal effective to cause the camera device to initiate capture of video data.

* * * * *